US006968957B2

(12) United States Patent
Fynn

(10) Patent No.: US 6,968,957 B2
(45) Date of Patent: Nov. 29, 2005

(54) MULTIPLE TRAY DESK ORGANIZER

(75) Inventor: Shaun Fynn, West Hollywood, CA (US)

(73) Assignee: Custom Plastics, Inc., Elk Grove Village, IL (US)

( * ) Notice: Subject to any disclaimer, the term of this patent is extended or adjusted under 35 U.S.C. 154(b) by 95 days.

(21) Appl. No.: 10/446,169

(22) Filed: May 23, 2003

(65) Prior Publication Data

US 2004/0108282 A1 Jun. 10, 2004

Related U.S. Application Data

(63) Continuation-in-part of application No. 29/161,994, filed on Jun. 6, 2002, now Pat. No. Des. 498,499.

(51) Int. Cl.[7] ..... B42F 17/00
(52) U.S. Cl. ..... 211/11; 211/13.1; 211/131.1
(58) Field of Search ..... 211/11, 131.1, 211/133.3, 133.4, 163, 13.1, 126.2; 248/282.1

(56) References Cited

U.S. PATENT DOCUMENTS 1,671,293 A * 5/1928 Jennens ..... 248/231.71
1,981,294 A * 11/1934 Wangen ..... 211/11
D205,848 S * 9/1966 Poole ..... D6/512
3,498,471 A * 3/1970 Dirkx ..... 211/131.1
4,756,429 A * 7/1988 Lehman et al. ..... 211/43
D311,829 S * 11/1990 Vossoughi ..... D6/418
4,971,234 A * 11/1990 Hay ..... 224/42.32
D321,011 S 10/1991 Blossom
5,152,405 A 10/1992 Schriner
D332,628 S * 1/1993 Brussing ..... D19/65
5,197,614 A 3/1993 Dalton et al.
D342,173 S * 12/1993 Kirchner et al. ..... D6/511
D353,159 S * 12/1994 Kirchner et al. ..... D19/92
D363,492 S * 10/1995 Brussing ..... D14/251
5,601,193 A 2/1997 Santoya
6,626,306 B1 * 9/2003 Bell ..... 211/144
6,648,390 B1 * 11/2003 Yang ..... 294/161

* cited by examiner

*Primary Examiner*—David Purol
(74) *Attorney, Agent, or Firm*—McHale & Slavin, P.A.

(57) ABSTRACT

A desk tray is mounted on a support surface with a support base. Extending vertically from the support base is an elongated rod carrying a spindle. The spindle and rod have several receptacles at different levels above the support surface. The spindle and rod are rotatably mounted on the support base.

11 Claims, 11 Drawing Sheets

MULTIPLE TRAY DESK ORGANIZER

RELATED APPLICATION

This application is C-I-P of U.S. patent application Ser. No. 29/161,994, filed Jun. 6, 2002, now U.S. Pat. No. D,498,499 the contents of which is incorporated herein by reference.

FIELD OF THE INVENTION

The present invention relates to organizers used to hold various desk top items and sundry items found about an office. Usually, the multi-function desk tray of the instant invention is mounted on a desk to reduce clutter but it may be mounted on any surface.

BACKGROUND OF THE INVENTION

Almost any desk has some type of organizer to separate and catagorize items needed to perform the functions of the user. Additionally, some sort of device is present that manages work flow and messages. Of course, some of the prior art devices are so large and complex that the usable desk space is reduced.

Desktop organizer assemblies are very popular in today's business environment and are used to provide additional storage areas by which people can sort and store documents and other items. One type of organizer assembly that has become popular is a multi-tray organizer assembly in which a plurality of trays are stacked one on top of the other in a compact vertical arrangement. Vertically stacked multi-tray organizers provide the user with a plurality of trays for storing different categories of documents, with each of the trays being easily assessible due to the vertical stacked nature of the trays.

Most vertically stacked multi-tray organizer assemblies suffer from drawbacks including the use of an integrated structure where the trays are provided in one piece with the frame of the assembly. This reduces the flexibility of the assembly since the user cannot remove or replace any of the trays, and the user cannot add additional trays and may present a problem in reaching items within the trays.

U.S. Pat. No. 5,601,193 discloses a static stand with message clips, note pads, calendar, and a small turn-table for notes. Because the various elements are spaced about the stand, it requires a large area of desk space and a long reach by the user. The stand is disclosed as a device helpful in prioritizing needed actions.

U.S. Pat. No. 321,011, issued to Blossom, shows another static organizer with several receptacles for different sized articles and a rack for larger parcels or files.

Other similar desk sets are disclosed by U.S. Pat. No. 5,197,614 and U.S. Pat. No. 5,152,405. These devices are useful in collecting items and reducing desk-top clutter.

What is needed in the art is an organizer that can be used to receive various items, prioritize responses, reduce the amount of working space occupied by the organizer but keep everything within conveniently easy reach.

SUMMARY OF THE PRESENT INVENTION

Disclosed is a multi-function tray for mounting on a support surface. The tray consists of a post base releasably securable to the support surface, employing an elongated rod having a longitudinal axis with a first end and a second end.

The first end of the elongated rod is attached to the post base and a tubular spindle is rotatably mounted about the longitudinal axis of the rod. The spindle having a bottom end and a top end, the bottom end of the spindle in rotating contact with rod with a receptacle mounted on the spindle intermediate to the bottom end. The top end extending normal to the longitudinal axis whereby the receptacle and spindle can rotate about the rod.

It is an objective of the present invention to provide a desk tray with multiple receptacles that are vertically oriented to reduce working space occupied by the device.

It is another objective of the present invention to provide rotation capability to the desk tray to allow items in the tray to be easily accessed by the seated user.

It is a further objective of the present invention to provide eccentric rotation of the desk tray to move the receptacles laterally closer to the user.

It is yet another objective of the present invention to provide a modular construction of the desk tray to permit various constructions desired by the user.

It is yet a further objective of the present invention to provide receptacles and dishes on the desk tray with different retaining devices.

DETAILED DESCRIPTION OF THE INVENTION

Figure 1:
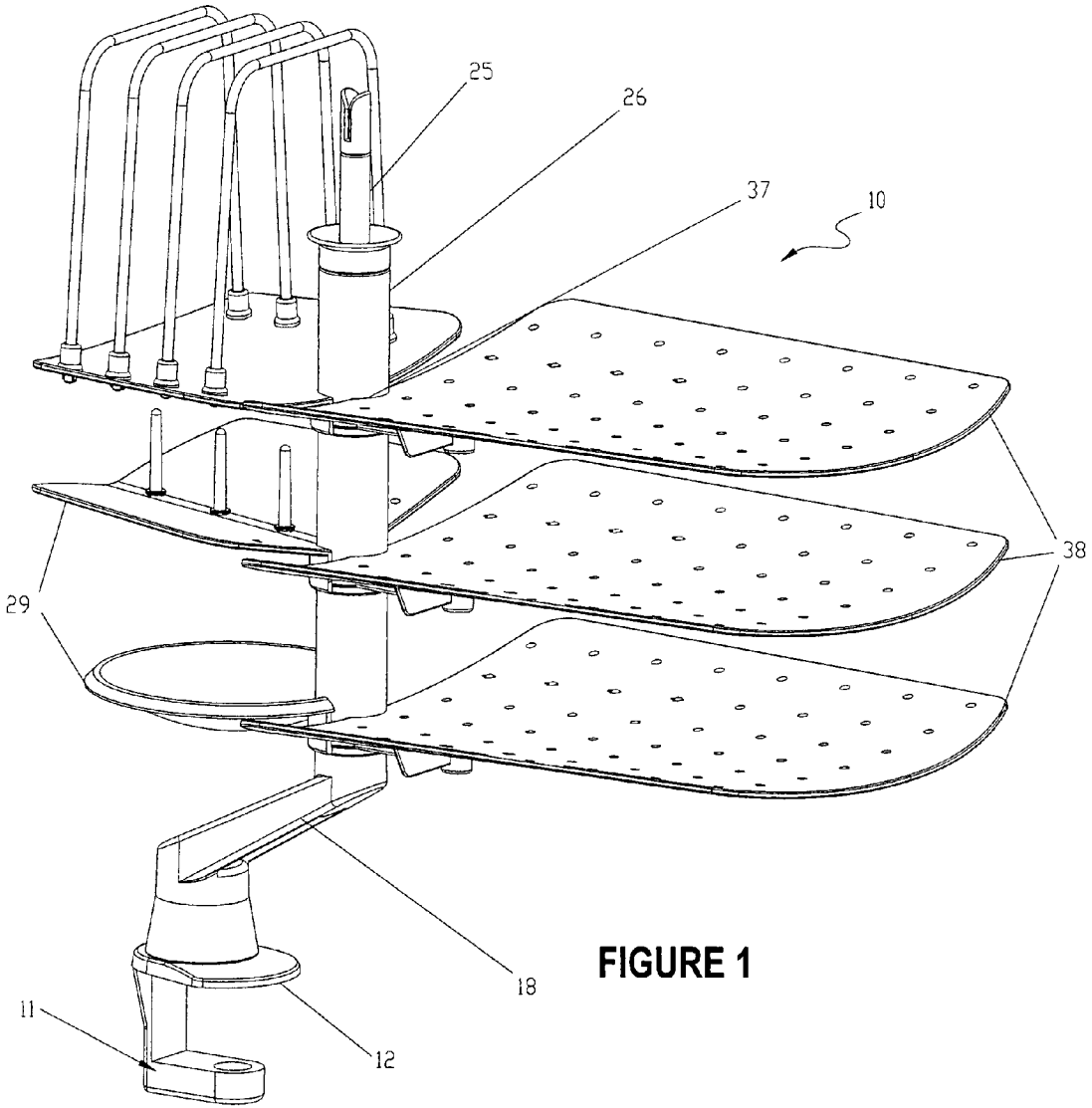
FIG. 1 is a perspective of the desk tray of a first embodiment of this invention.

Referring now to the figures, the desk tray 10 is mounted to a support surface 100, such as a desk or table or other suitable support, by a support base 11. The support base provides stability and rigidity to the desk tray by the enlarged circumference 12 in contact with the support surface. While the support base is shown as circular, it may have other geometric forms. The support base is illustrated as being fixed to the support surface 100 by mounting plate 101 and screws or bolts 102. The support base may be affixed to the support surface by other devices, such as clamps, magnets or adhesives.

The support base has a central aperture 13. Within the aperture are the connectors 103 for the bolts 102. Also within the central aperture 13 is a bore 15. Bushings 16, 17 are fitted within the bore 15.

An angle arm 18 is rotatably mounted on the support base 11 by an axle 19 extending from one end 21 of the angle arm.

The axle 19 rotates in the bushings 16, 17. The free end of the axle 19 extends through the bushings and is fastened with a locking washer 20 completing the assembly of this module. The angle arm 18 and axle 19 form a crank arm 22 that displaces the second end 23 horizontally and vertically from the first end 21.

The second end 23 of the angle arm 18 has a threaded well 24 which is approximately parallel with the axle 19. An elongated rod 25 having a threaded end 42 is threaded into the well and extends outwardly from the angle arm in the opposite direction from the axle 19.

In operation, this portion of the desk tray has a support base fixed to the support surface with the angle arm extending laterally from the center of the support base to rotate in a plane parallel to the support surface. As it rotates, the elongated rod is substantially perpendicular to the support surface and describes a cylinder about the support base that has the angle arm as a radius.

Figure 2:
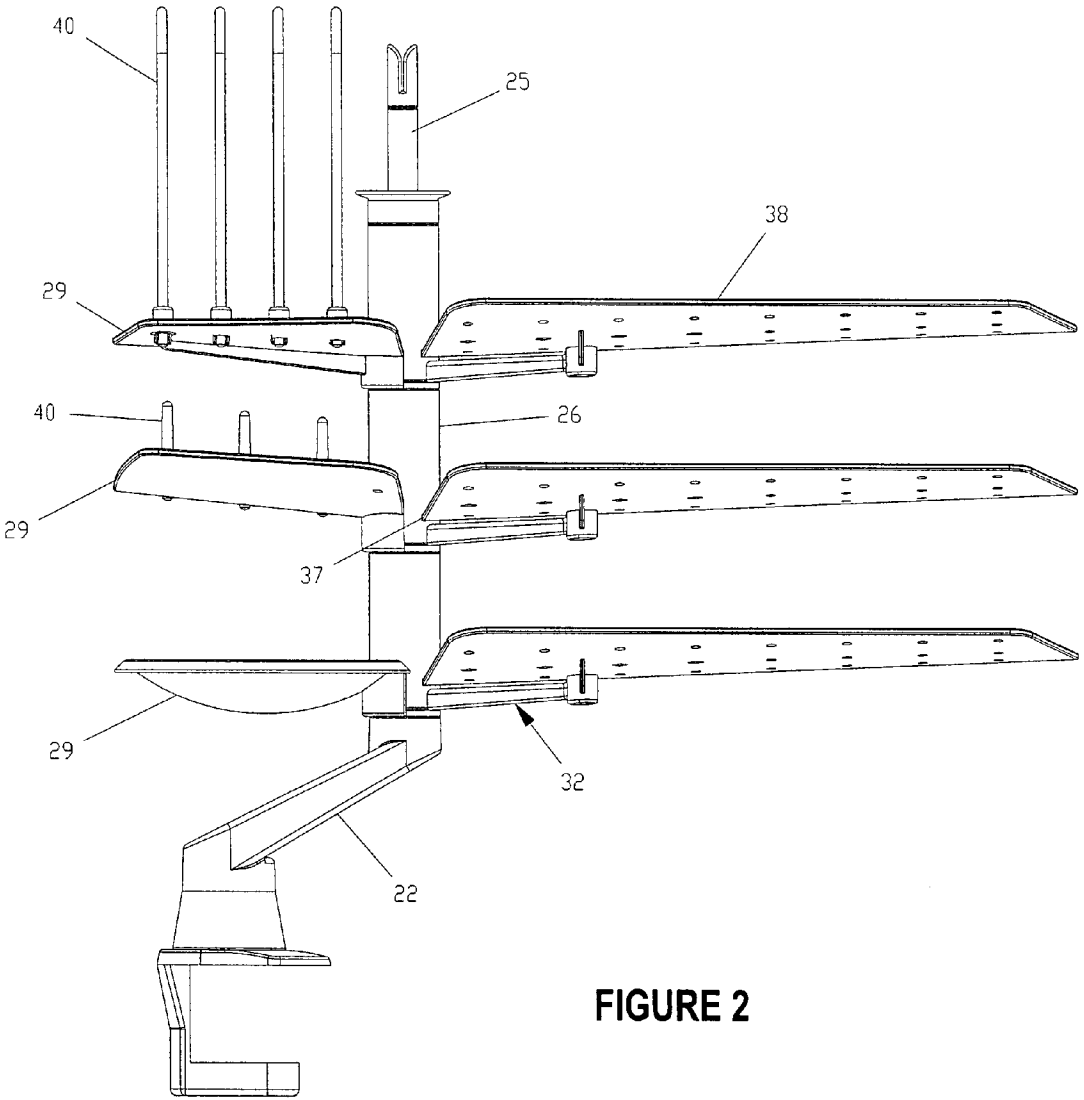
FIG. 2 is a side view of the assembled desk tray of FIG. 1.
Figure 3:
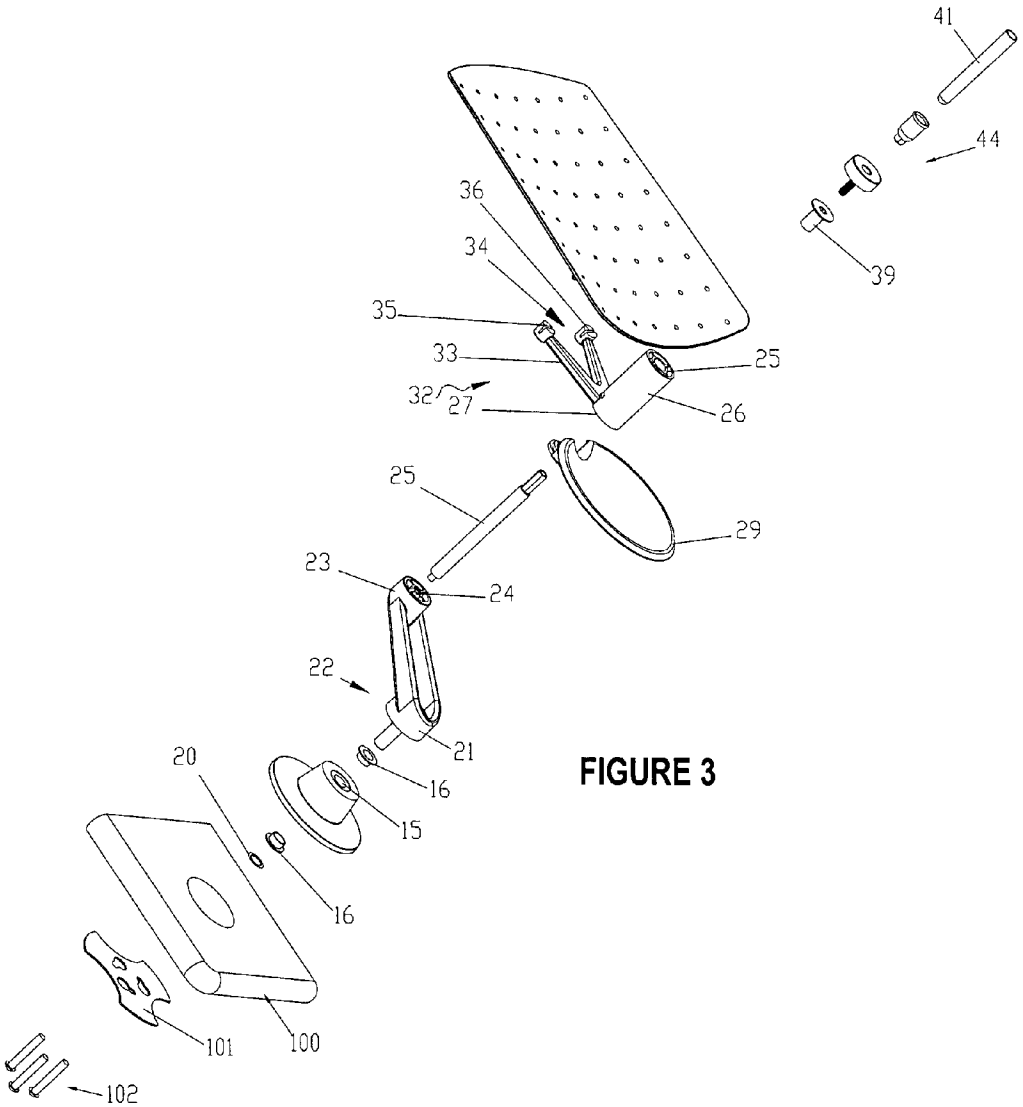
FIG. 3 is an exploded view of the desk tray assembly.
Figure 4:
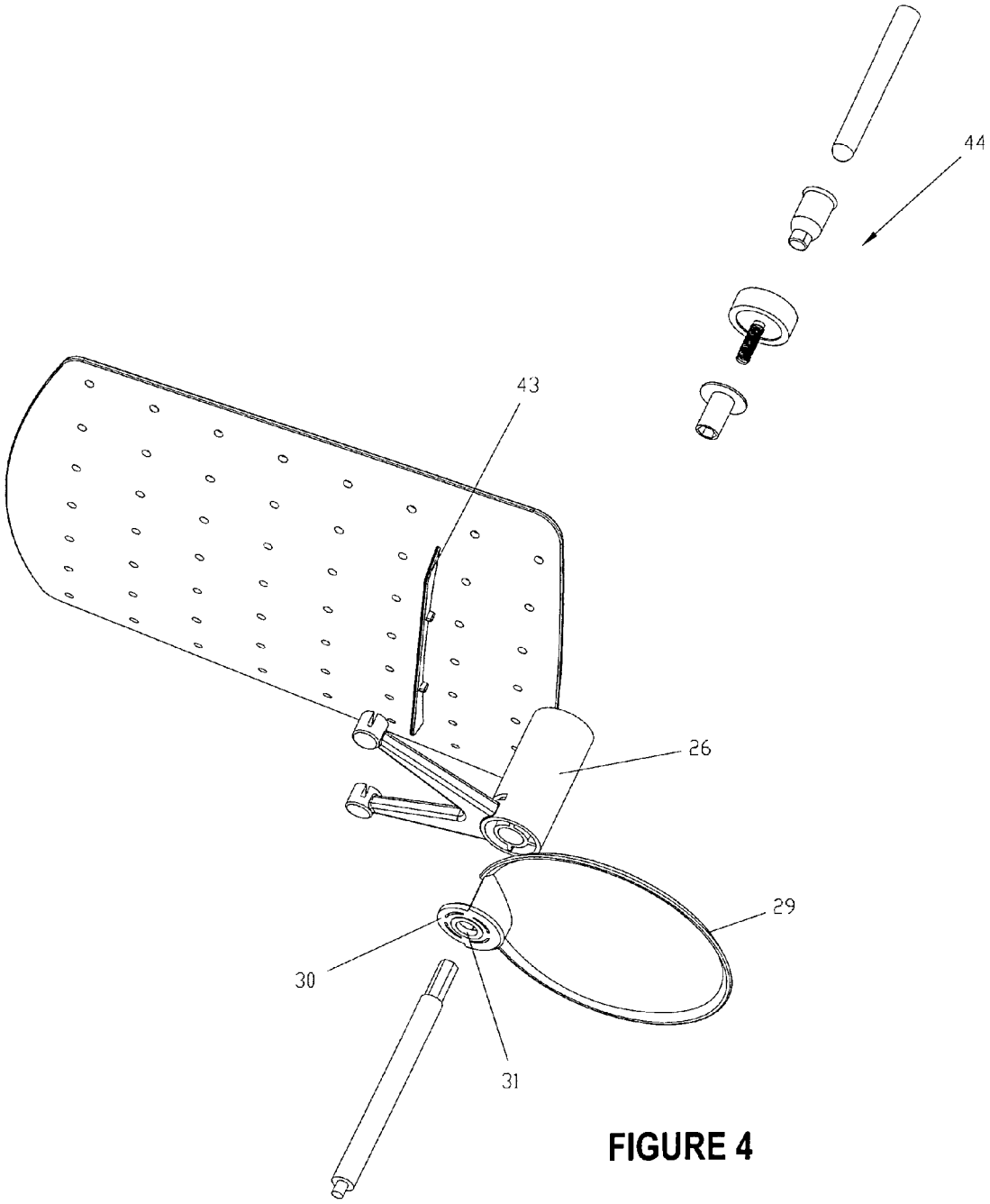
FIG. 4 is an exploded perspective of the spindle and receptacle of this invention.
Figure 5:
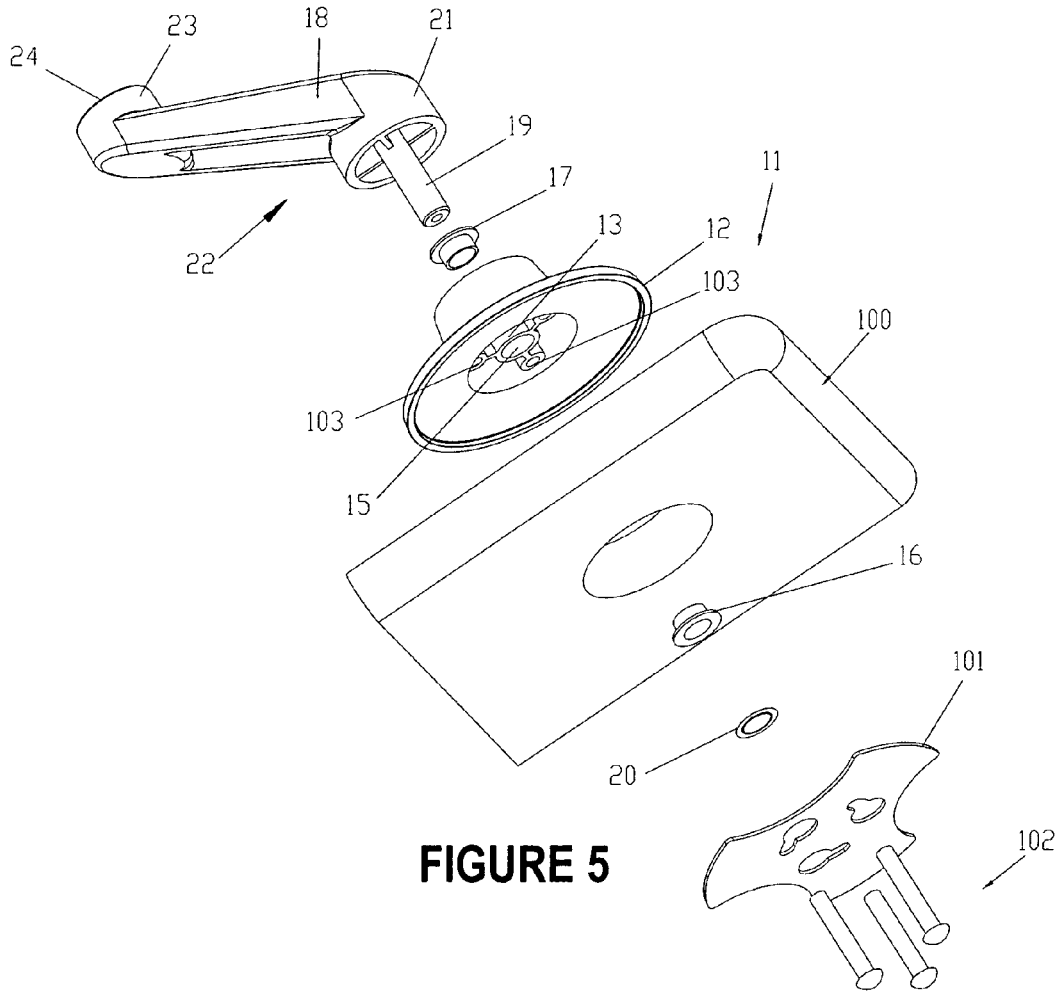
FIG. 5 is an exploded perspective of the support base and angle arm of the desk tray of this invention.
Figure 6:
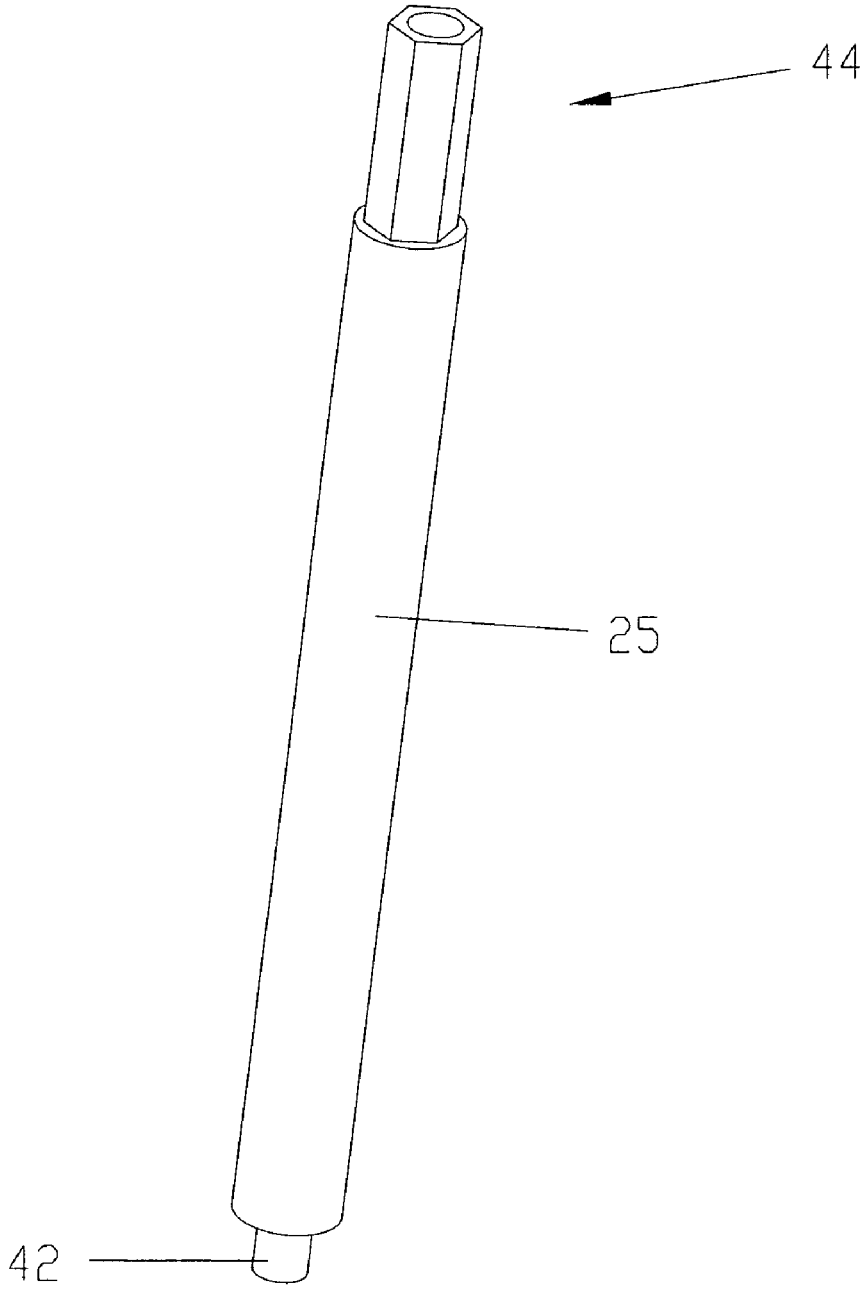
FIG. 6 is an enlarged perspective of the elongated rod of this invention.

An elongated tubular spindle 26 is mounted on the rod 25. The spindle has a bottom end 27 and a top end 28. The module, shown in FIG. 2, illustrates a dish 29 connected to the rod 25. The dish has a semi-circular flange 30 in the periphery defined by a semi-circular recess which receives the bottom end 28 of the spindle. The flange 30 has an aperture 31 through which the elongated rod 25 passes securing the dish to the rod. The flange 30 of the dish periphery is secured between the bottom end of the spindle and the second end of the angle arm. The semi-circular recess serves as a contact spacer and guide to maintain the orientation of the spindle and dish. The dish 29 may have a concave surface or it may include a rack 40 or different dishes may be present at the same time, as shown in FIG. 1. The rack 40 may be closed loops or open posts. The dish may be round, oval or rectilinear in outline.

Intermediate the ends of the tubular spindle, there is a bracket 32. The bracket is shown as two laterally extending arms 33, 34 with bores 35, 36 in the ends of the arms. On the tubular spindle 26 near the base of the bracket, there is a groove 37 formed in the spindle.

A receptacle 38 is attached to the bracket with fasteners extending through the bores 35,36 and into the receptacle. The inner edge of the receptacle is stabilized by insertion into the groove 37. The orientation of the arms of the bracket and the cross sectional shape of the receptacle, including the fin 43, are such that the receptacle will be substantially parallel with the support surface when attached.

The top end 28 of the spindle is fitted with a bushing 39 through which rod 25 extends to terminate with a removable threaded fitting 44 which protrudes through (39) into top of (25) to secure the assembly together. The threaded fitting may have an external paper clip 41 for messages or a CD tower, or the combination of both, which fits into the threaded fitting.

As shown in FIG. 1, several tubular spindle and receptacle modules may be stacked on a rod 25 to form a multi-level desk tray having several receptacles and several dishes, as desired. Also, as shown, the dishes and the receptacles may be disposed opposite one another along the longitudinal axis of the rod or in staggered angular relationships. Further, the spindle modules and dishes may be rotatably mounted on the rod.

The desk tray may be made of molded polymers or metals or it may be assembled from machined parts.

Figure 7:
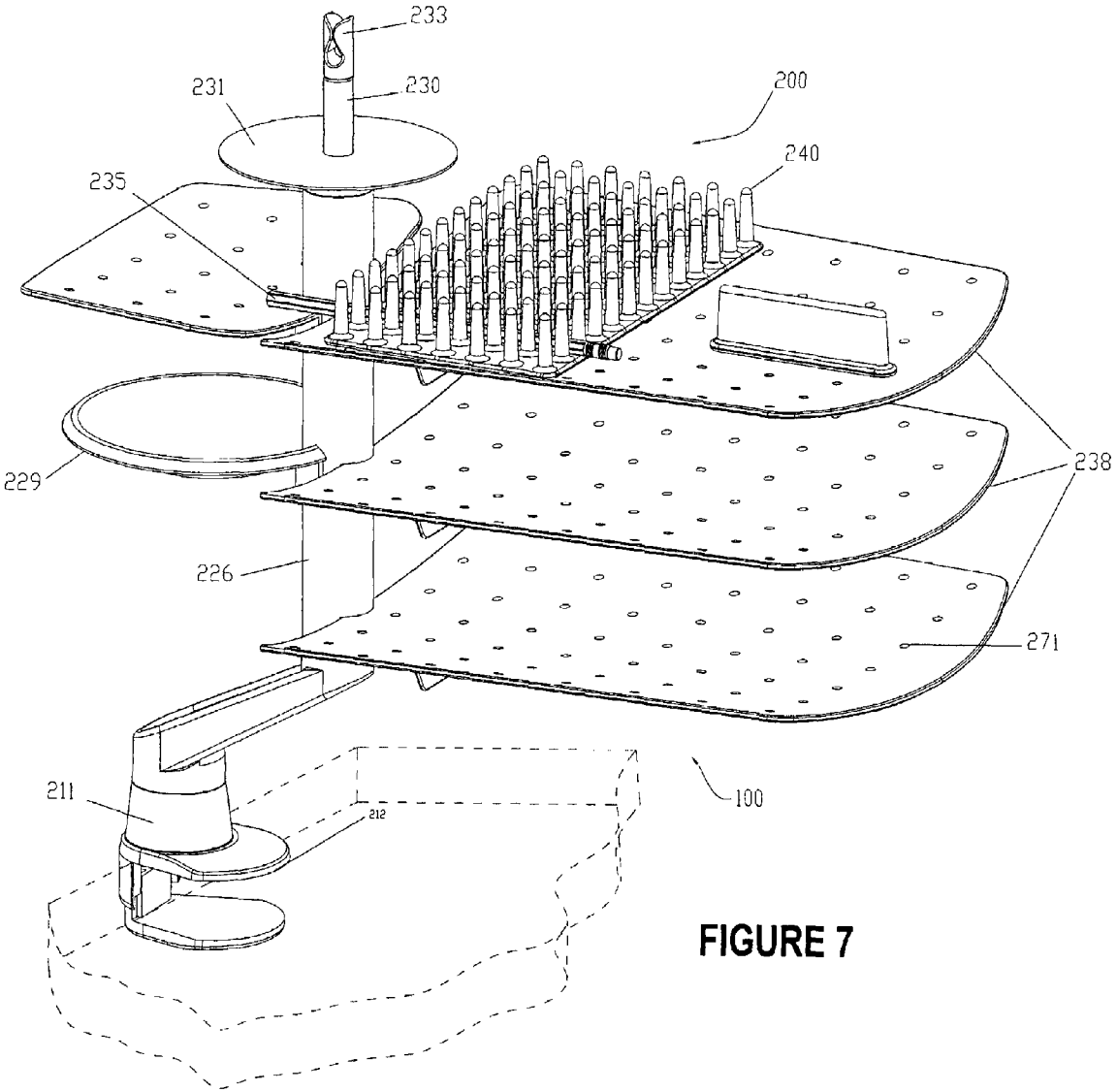
FIG. 7 is a perspective of the desk tray having finger plates with and depicting desk items placed on the tray.
Figure 8:
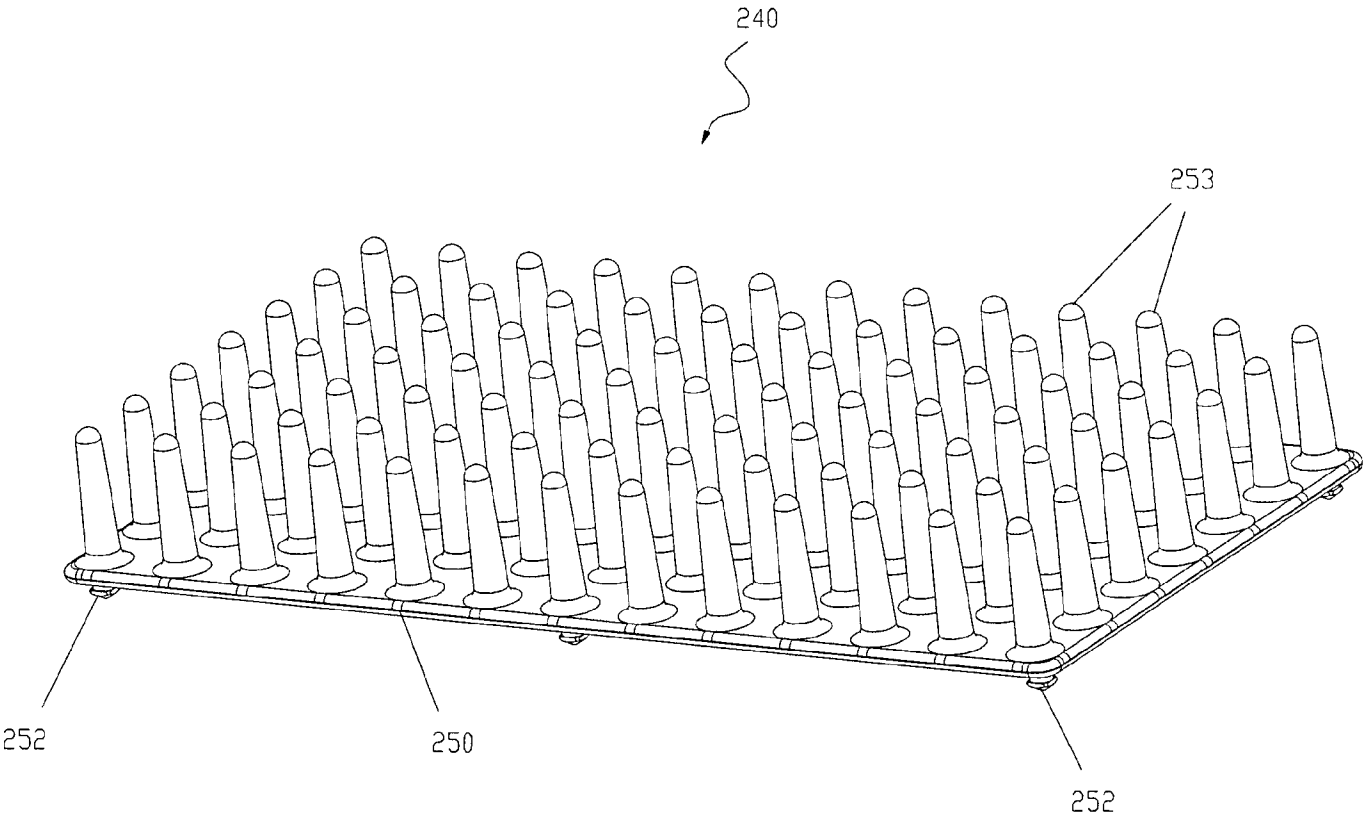
FIG. 8 is a perspective of a small item holder.
Figure 9:
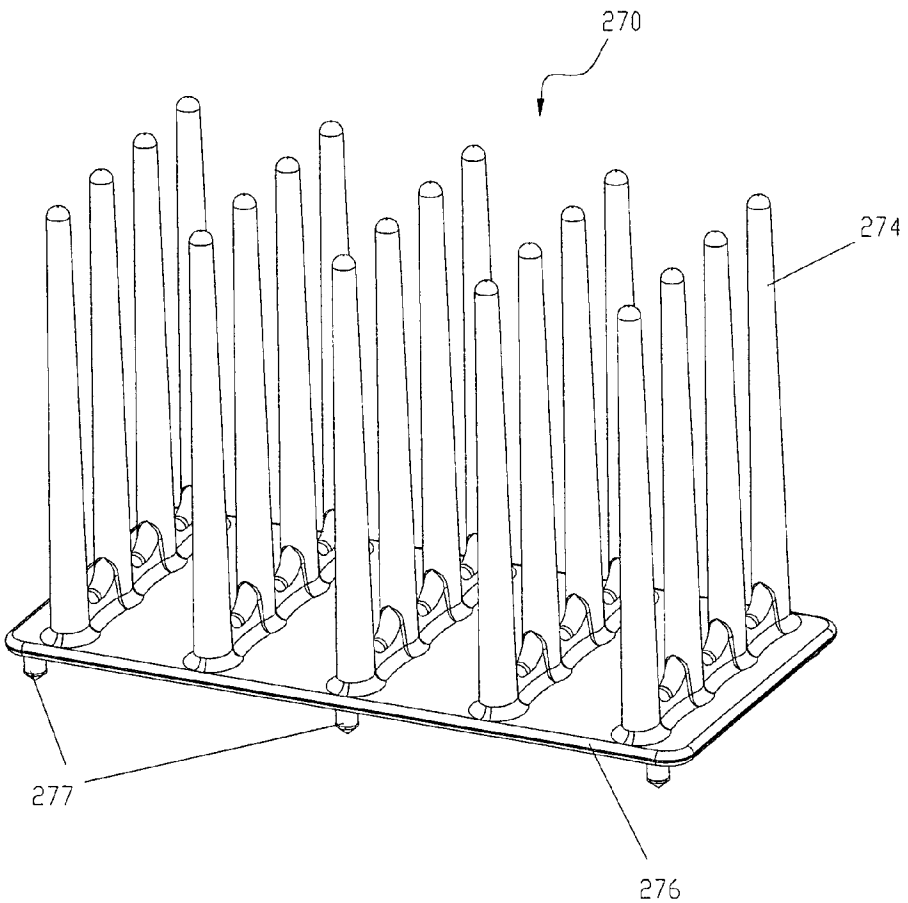
FIG. 9 is a perspective of a large item holder.

Referring now to FIGS. 7–9, shown is the desk tray 200 mounted to a support surface 100, such as a desk or table or other suitable support, by a support base 211. The support base provides stability and rigidity to the desk tray by the enlarged circumference 212 in contact with the support surface.

An elongated tubular spindle 226 provides a central support structure, the top portion 230 is sized to receive CD and DVD discs 231. A slot 233 along the top portion 230 permits placement of large envelops, such as an EXPRESS MAIL letter package. Dish 229 includes a concave shape for use in holding various desk top items such as paper clips, rubber bands, and so forth. Receptacles 238 are available for placement of letters, documents, and the like. The receptacles can be rotated around the spindle for ease of access. Referring to FIG. 8, an attachment to the receptacle is a holder 240 formed from flexible plastic or rubber that can be placed on the receptacle for use in holding odd shaped items such as pencils 235 or larger items which may fold some of the fingers to accommodate the space required. The holder 240 is formed from a base sheet 250 having a plurality of flexible fingers 253 extending upward therefrom. The use of flexible fingers allows the secure holding of larger items such as keys, 3.5" hard case computer discs, and so forth. An example of holder 240 option would include a base sheet of about 5 inches by 10 inches with a finger size lengths of about 1 inch. Tabs 252 extend downwardly from the base sheet 250 for use in engaging tab hole openings 271 located on each receptacle. FIG. 9 depicts a holder 270 formed from a base sheet 272 having a plurality of flexible fingers 274 extending upward therefrom. The use of flexible fingers allows the secure holding of larger items such as envelops, postcards, jewel boxes, and so forth. An example of holder 270 would have a base sheet 276 of about 6.5 inches by 3 inches with a finger size 274 of about 4.25 inches. Tabs 277 extend downwardly from the base sheet 276 for use in engaging tab hole openings located on each receptacle.

Figure 10:
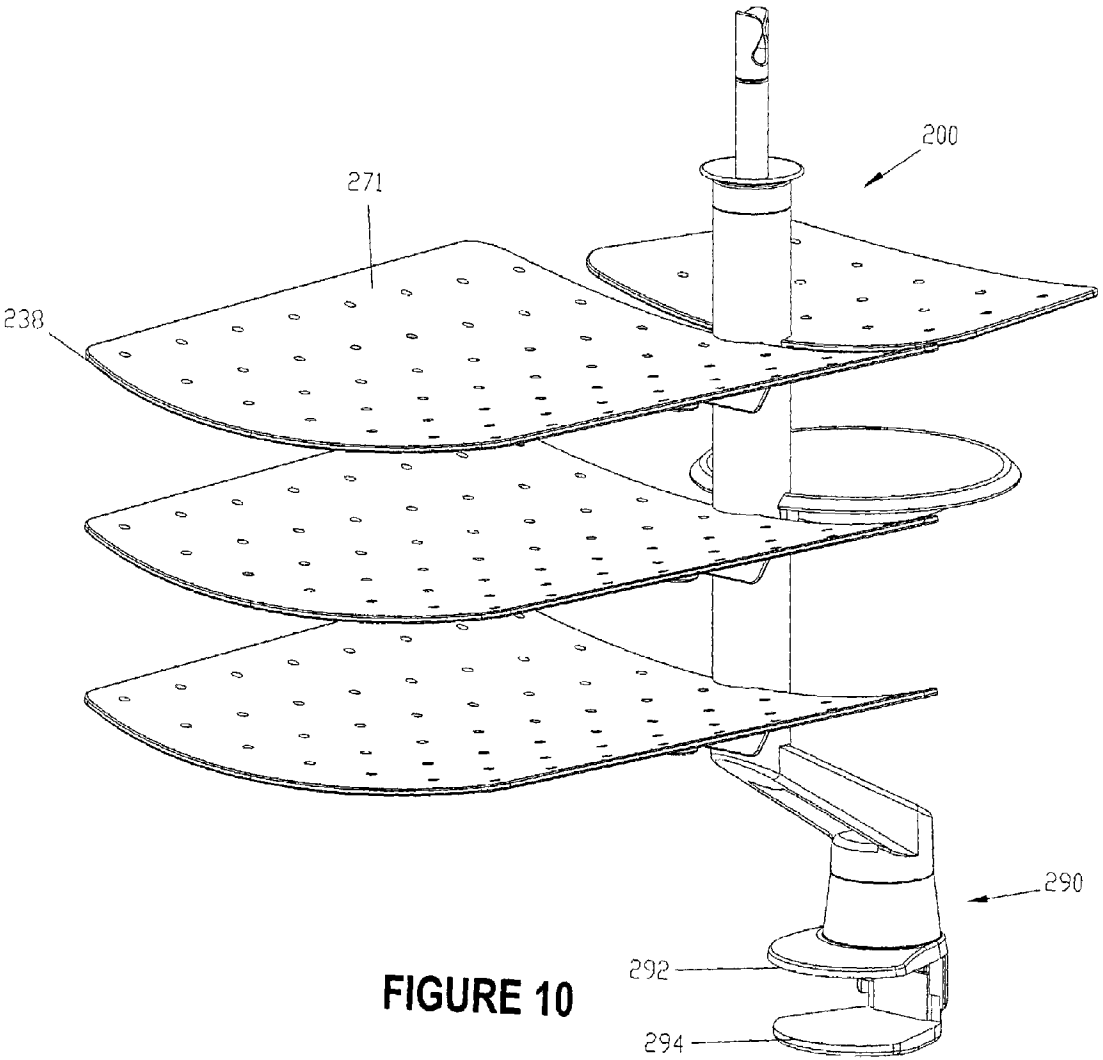
FIG. 10 is a perspective of the desk tray having a clamp-on attachment.
Figure 11:
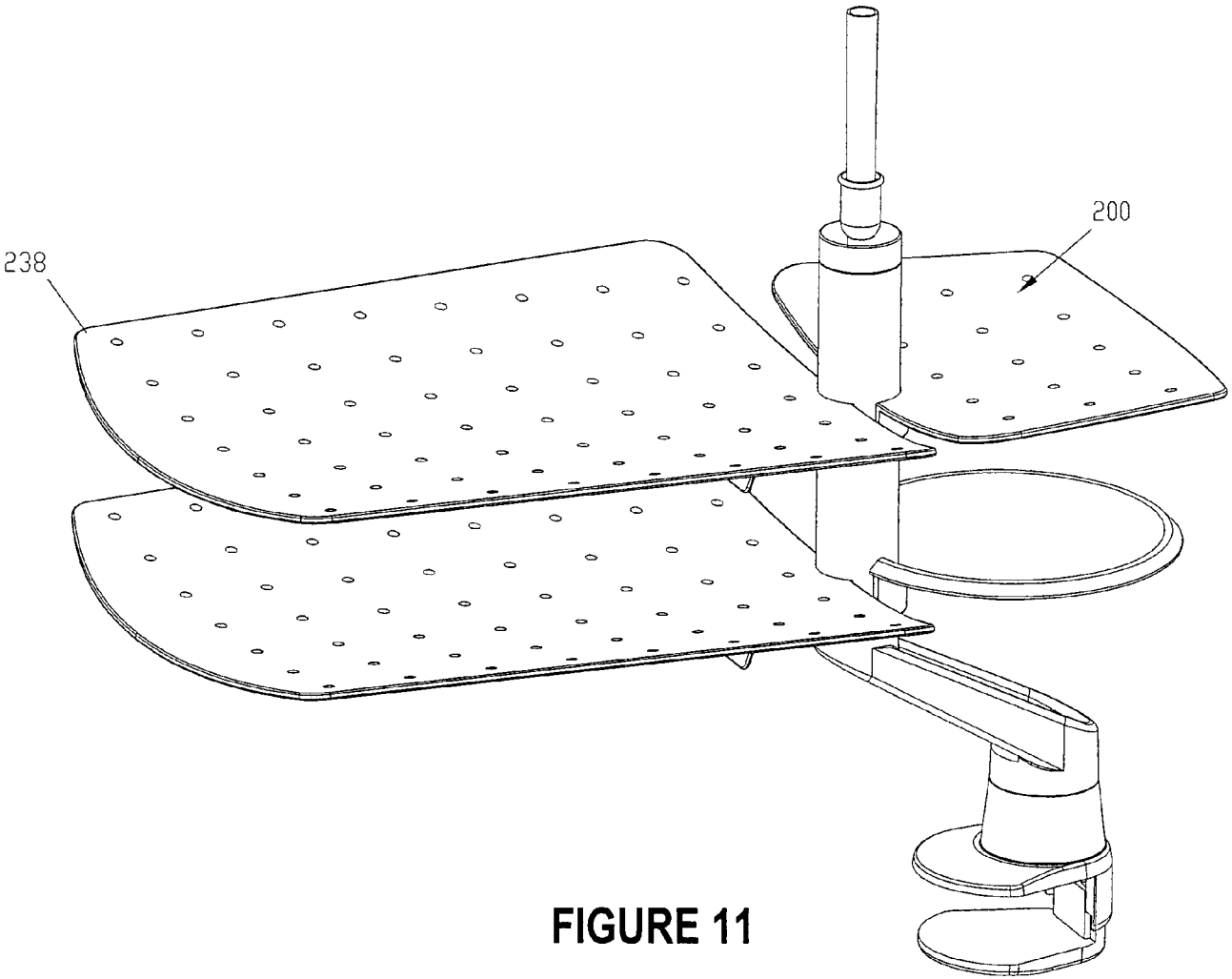
FIG. 11 is a perspective of the desk tray of depicting a variation of the tray assembly.

FIG. 10 illustrates the desk tray 200 with a clamp 290 for placement over the lip of a desk, not shown. The clamp can be of a fixed spacing between upper support 292 and lower support 294. Alternatively, the supports may be made adjustable by use of a conventional threaded bolt or the like clamp adjustments known in the industry. FIG. 11 illustrates that the tray 200 can be customized by the end user to include as few, or as many, receptacles 238 to address the amount of workable storage area.

Therefore, the foregoing is considered as illustrative only of the principles of the invention. Further, since numerous modifications and changes will occur to those skilled in the art, it is not desired to limit the invention to the exact construction and operation shown and described herein.

What is claimed is:

1. A multi-function tray for mounting on a support surface, said tray comprising a post base adapted to be attached to said support surface, an angle arm having first end rotatably mounted on said post base, said angle arm having a second end horizontally and vertically displaced from said first end, an elongated rod having a longitudinal axis with a first end and a second end, said first end of said elongated rod attached to said second end of said angle arm, a tubular spindle rotatably mounted about said longitudinal axis of said rod, said spindle having a bottom end and a top end, said bottom end in rotating contact with said second end of said angle arm, a receptacle mounted on said spindle intermediate said bottom end and said top end extending normal to said longitudinal axis whereby said elongated rod and said angle arm can rotate about said post base, whereby said receptacle and spindle can rotate about said rod.

2. A multi-function tray of claim 1 wherein said tray includes a second tubular spindle having a top end, a bottom end, and a second intermediate receptacle rotatably mounted about said longitudinal axis of said rod, said bottom end of said second tubular spindle in rotating contact with said top end of said tubular spindle.

3. A multi-functional tray of claim 2 wherein said tray includes a plurality of similar tubular spindles each having a bottom end, a top end and an intermediate receptacle, are sequentially rotatably mounted about said longitudinal axis of said rod, said bottom end of one of said plurality of spindles is in rotating contact with said top end of said second tubular spindle, the bottom end of each sequential spindle rotatably contacting the top end of the adjacent similar tubular spindle, said second end of said rod rotatably connected to the top end of said plurality of tubular spindles.

4. A multi-function tray of claim 3 wherein said tray includes a plurality of dishes each having a connection on the periphery, said each connection affixed to said rod between said plurality of sequential tubular spindles, said dishes extending normal to said longitudinal axis of said rod.

5. A multifunctional tray of claim 4 wherein said plurality of dishes and said intermediate receptacles are disposed approximately opposite to each other about said rod.

6. A multi-function tray of claim 4 wherein said plurality of dishes include at least one dish with a rack mounted within said periphery.

7. A multi-functional tray of claim 2 wherein said tray includes at least two dishes, each dish having a periphery, said periphery of each dish having a connector, a first dish attached to said rod by a first connector, said first dish disposed between said second end of said angle arm and said bottom end of said spindle, a second dish attached to said rod by a second connector between said top of said spindle and said bottom of said second tubular spindle.

8. A multi-function tray of claim 1 wherein said tubular spindle includes an integral bracket intermediate said top end and said bottom end, said receptacle affixed to said bracket.

9. A multi-function tray of claim 3 wherein said plurality of similar tubular spindles each include an integral bracket, each intermediate receptacle of each similar tubular spindle fixed to each integral bracket.

10. A multi-function tray for mounting on a support surface, said tray comprising a post base adapted to be attached to said support surface, an angle arm having one end rotatably mounted on said post base, said angle arm having a second end horizontally and vertically displaced from said first end, an elongated rod having a longitudinal axis with a first end and a second end, said first end of said elongated rod attached to said second end of said angle arm, a plurality of tubular spindles mounted about said longitudinal axis of said rod, each of said plurality of tubular spindles having a bottom end, a top end, and an intermediate receptacle extending approximately normal to said elongated rod, said bottom of one of said plurality of tubular spindles engaging said second end of said angle arm, said top end of said one of said plurality of tubular spindles engaging the bottom end of an adjacent spindle whereby said angle arm rotates said plurality of spindles about said post base.

11. A multifunction tray of claim 10 wherein said tray includes a plurality of dishes, said dishes having a periphery with a connector in said periphery, said connector connected to said elongated rod, each of said plurality of dishes disposed on said elongated rod intermediate a top end and a bottom end of adjacent tubular spindles.

* * * * *